US010682561B2

(12) United States Patent
McLendon

(10) Patent No.: US 10,682,561 B2
(45) Date of Patent: Jun. 16, 2020

(54) GOLF SWING TRAINING DEVICE

(71) Applicant: John McLendon, Willow Park, TX (US)

(72) Inventor: John McLendon, Willow Park, TX (US)

( * ) Notice: Subject to any disclaimer, the term of this patent is extended or adjusted under 35 U.S.C. 154(b) by 0 days.

(21) Appl. No.: 15/853,112

(22) Filed: Dec. 22, 2017

(65) Prior Publication Data

US 2019/0192943 A1 Jun. 27, 2019

(51) Int. Cl.
*A63B 69/36* (2006.01)
*A63B 69/00* (2006.01)

(52) U.S. Cl.
CPC ..... *A63B 69/3608* (2013.01); *A63B 69/0059* (2013.01); *A63B 69/3623* (2013.01); *A63B 69/3641* (2013.01); *A63B 2209/10* (2013.01); *A63B 2225/09* (2013.01); *A63B 2225/093* (2013.01)

(58) Field of Classification Search
CPC ..... A63B 69/3641; A63B 69/3647; A63B 69/365
USPC ..... 473/213
See application file for complete search history.

(56) References Cited

U.S. PATENT DOCUMENTS 2,980,426 A * 4/1961 Johnson ..... A63B 69/0046 473/213
3,339,926 A * 9/1967 Coupar ..... A63B 69/0059 473/214
5,127,650 A 7/1992 Schneller
5,156,401 A 10/1992 Hodgkiss
5,465,971 A 11/1995 Tischler
5,520,392 A 5/1996 Foresi et al.
5,529,306 A * 6/1996 Staats ..... A63B 69/0059 473/208
5,997,408 A 12/1999 Bankhead
6,206,018 B1 * 3/2001 Daniels, Jr. ..... A61H 3/02 135/69
6,283,874 B1 9/2001 Studebaker
6,533,676 B1 3/2003 D'Angelo et al.
7,740,544 B2 * 6/2010 Williams ..... A63B 69/3608 473/212
7,789,763 B1 * 9/2010 Smith ..... A63B 69/3608 473/212
8,043,162 B2 * 10/2011 Sery ..... A63B 69/3608 473/212

(Continued)

OTHER PUBLICATIONS

Combined Search and Examination Report in Related UK application No. GB1821127.6, dated May 9, 2019, 5 pages.

*Primary Examiner* — Raeann Gorden
(74) *Attorney, Agent, or Firm* — Law Office of Jeff Williams PLLC; J. Oliver Williams

(57) ABSTRACT

A golf swing training device includes a shoulder pad, a shaft, and a wrist attachment member. The pad and the attachment member are configured to extend between opposing sides of a golfer, namely between an armpit of the trailing side of the body and the wrist of the leading side of the golfer. The shaft extends between the pad and the attachment member and is adjustable in length to fit the needs of a particular golfer. The shaft is configured to maintain a selected distance between the wrist and the armpit of the golfer during a golf swing so as to teach a body to keep the leading arm strait and to encourage rotation of the torso.

8 Claims, 5 Drawing Sheets

(56) References Cited

U.S. PATENT DOCUMENTS

| | | | | |
|---|---|---|---|---|
| 8,157,666 | B2 * | 4/2012 | Schutte | A63B 69/3623 473/212 |
| 8,177,652 | B2 * | 5/2012 | Schutte | A63B 69/3608 473/212 |

* cited by examiner

GOLF SWING TRAINING DEVICE

BACKGROUND

1. Field of the Invention

The present application relates to a golf training device, and more particularly to an adjustable device that extends between the cavity of the arm pit and the opposing wrist to help a golfer maintain proper form during a swing.

2. Description of Related Art

The game of golf is a simple in its concept but very difficult to perfect. Much of the game deals with the technique and form of the golfer as they swing a club. Great effort and skill is required to perfect one's shot. Many players obtain professional coaches and spend hours each day practicing.

The iron Byron is considered to be a "perfect swing" and one in which many players attempt to emulate. There are three key parts of a "perfect swing": (1) Circular Body Rotation around the torso of the player to make a complete shoulder turn; (2) an Unrestricted Hinge at the end of a rigid arm that moves freely to mimic the cocking and uncocking of the human wrists; and (3) a constant forward tilt to maintain a fixed angle relative to the ground. The concept is to have the swing develop from movement of the back and chest in combination with the arms.

A complete shoulder turn can be one of the most important fundamentals in the golf swing. A full shoulder turn means that the shoulders turn 90 degrees so as to be perpendicular to the leg stance. The lead shoulder (left shoulder for a right-handed golfer) should be under the chin, and the back should be facing the target. The benefit of this full turn is that it enables the downswing to follow the correct sequence. With the shoulders turned about 90 degrees, they will be unwinding after the hips unwind. This is what allows the club to hit the ball from the inside. A full shoulder turn helps the player make a bigger arc with the swing.

It is found that accomplishing the act of maintaining an unrestricted hinge aids in creating increased body rotation so as to make a complete shoulder turn. The unrestricted hinge refers to making the leading arm stay in a straitened orientation during the swing. When this occurs, the torso is more inclined to rotate.

Many different types of devices have been developed to improve and teach a correct swing. Most include sensors, electronics, bulky contraptions, and so forth. For example, many devices have sensors that measure performance but do not correct performance or compel the body to perform in a particular manner in the swing. Of devices that may be suited to compel bodily movement, they are cumbersome, large, and not easily transported.

Although strides have been made to provide an improved golf swing, shortcomings remain. A simple device that teaches correct orientation of the leading arm and facilitates proper rotation is needed. It is desired that the device be portable and can be carried by the player in their golf bag.

SUMMARY OF THE INVENTION

It is an object of the present application to provide a simple device that teaches correct orientation of the leading arm and facilitates proper rotation is needed. It is desired that the device be portable and can be carried by the player in their golf bag. The device is configured to pivot about the arm pit of the trailing arm and connect to the opposing wrist so as to maintain a continuous distance between the two points. This helps to not only teach and familiarize a golfer with a proper technique, but it helps to maintain a proper triangular form between the chest and arms of the golfer. By restricting the distance between the leading wrist and the opposing shoulder, a golfer is able to maintain a triangular form during the swing. This allows the arms and upper body to move together and avoid overactive arms. The swing is therefore repeatable and stable thus maximizing the potential for a square head impact on the ball.

It is a further object of the present application that the device be portable and easily used. The device includes an upper pad, a shaft, and a wrist attachment member. The shaft is adjustable to permit use with different sized golfers. The wrist is permitted to rotate freely about the bottom of the shaft. The wrist attachment member is selectively attachable to the wrist of the leading arm and adjustable in size to conform to the player size. In use, the player merely places the upper pad under the arm of the trailing arm and connects the attachment member to the wrist of the leading arm and practices a swing motion. The shaft forces the leading arm to maintain a particular spacing from the shoulder of the trailing arm. The arc of the swing increases and more rotation is encouraged.

The more important features of the device have thus been outlined in order that the more detailed description that follows may be better understood and to ensure that the present contribution to the art is appreciated. Additional features of the device will be described hereinafter and will form the subject matter of the claims that follow.

Many objects of the present device will appear from the following description and appended claims, reference being made to the accompanying drawings forming a part of this specification wherein like reference characters designate corresponding parts in the several views.

Before explaining at least one embodiment of the device in detail, it is to be understood that the device is not limited in its application to the details of construction and the arrangements of the components set forth in the following description or illustrated in the drawings. The device is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the various purposes of the present device. It is important, therefore, that the claims be regarded as including such equivalent constructions insofar as they do not depart from the spirit and scope of the present device.

DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
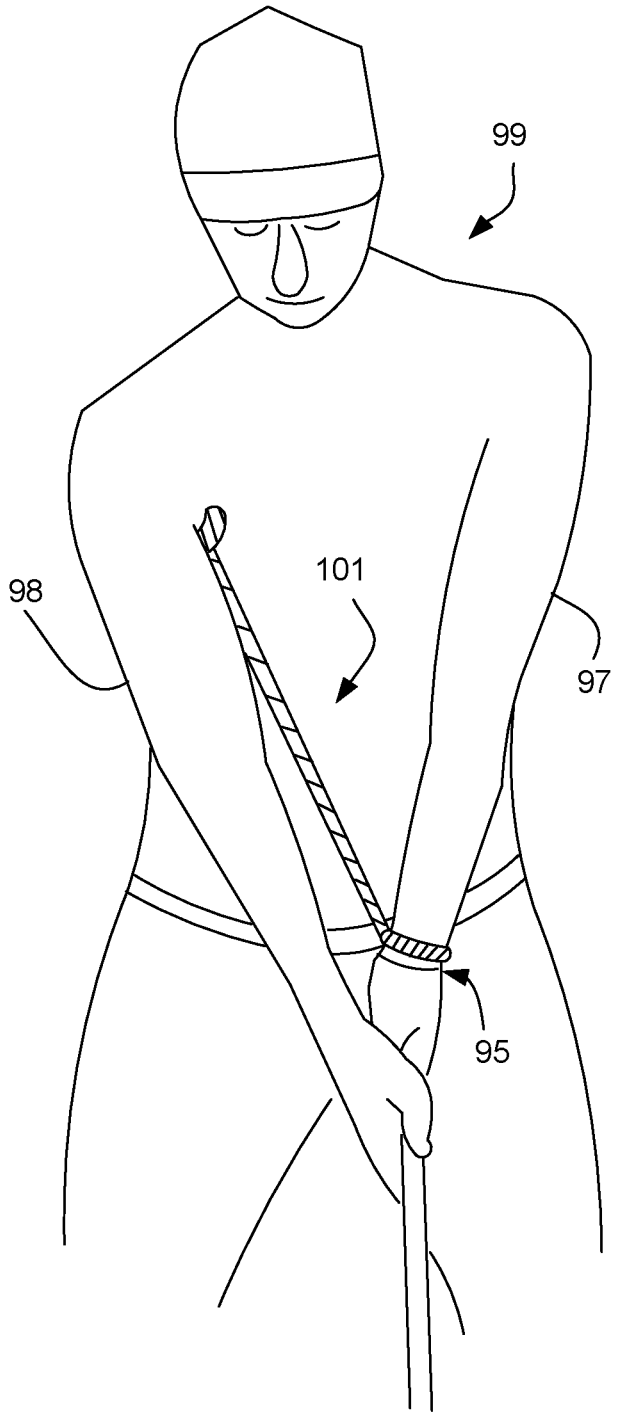
FIG. 1 is a perspective view of a player using a golf swing training device according to an embodiment of the present application.

While the device and method of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE PREFERRED EMBODIMENT

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the assembly described herein may be oriented in any desired direction.

The device and method in accordance with the present application overcomes one or more of the above-discussed problems commonly associated with golf swings discussed previously. In particular, the device is configured to maintain a relatively consistent distance between the trailing arm's shoulder and the leading arm's wrist in a golf swing. The device is configured to flex to assist in the fluid motion of the body. The length of a shaft used to maintain the selected distance is adjustable to facilitate use by golfers of all ages and sizes. Overall, the device of the present application is a simple, compact, and cost sensitive device capable of teaching the body correct movement for a golf swing. These and other unique features of the assembly are discussed below and illustrated in the accompanying drawings.

The device and method will be understood, both as to its structure and operation, from the accompanying drawings, taken in conjunction with the accompanying description. Several embodiments of the assembly may be presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless otherwise described.

The device and method of the present application is illustrated in the associated drawings. The device includes an upper shoulder pad, a shaft, and a wrist attachment member. The shoulder pad acts as a pivot point during a swing motion. The shaft extends between the wrist attachment member and the shoulder pad and is used to maintain a selected distance between the trailing shoulder and the leading wrist of the player. This helps to increase the arc of the swing, and teach the body a more accurate and effective swing movement. Additional features and functions of the device are illustrated and discussed below.

Referring now to the Figures wherein like reference characters identify corresponding or similar elements in form and function throughout the several views. The following Figures describe the device of the present application and its associated features. With reference now to the Figures, an embodiment of the modular observation assembly and method of use are herein described. It should be noted that the articles "a", "an", and "the", as used in this specification, include plural referents unless the content clearly dictates otherwise.

Referring now to FIG. 1 in the drawings, a perspective view of a golf swing training device 101 is illustrated. In a golf swing, the golfer 99 stands at the ball and aligns his/her club with the ball. The legs are typically separated so as to straddle both sides of the ball. The body is aligned parallel to the direction of travel for the ball. In a swing the body of golfer 99 rotates rearward away from the ball and quickly swings forward to make contact. The side of the body (arm and leg) closest to the pin is the leading side. The side of the body farthest from the pin is the trailing side. This is applicable for either right-handed or left-handed golfers.

Device 101 is configured to engage the trailing arm 98 and the leading arm 97 simultaneously in a swing and act to restrict the movement of the leading wrist 95 from collapsing toward the shoulder of the trailing arm 98. As seen in FIG. 1, device 101 is positioned with the player in a stance at the ball prior to swinging. Device 101 is attached at wrist 95 and is seated in the armpit of trailing shoulder 98. By maintaining a proper distance between the shoulder and the wrist, the body of the player is encouraged to maintain a strait arm orientation at arm 97.

Figure 2:
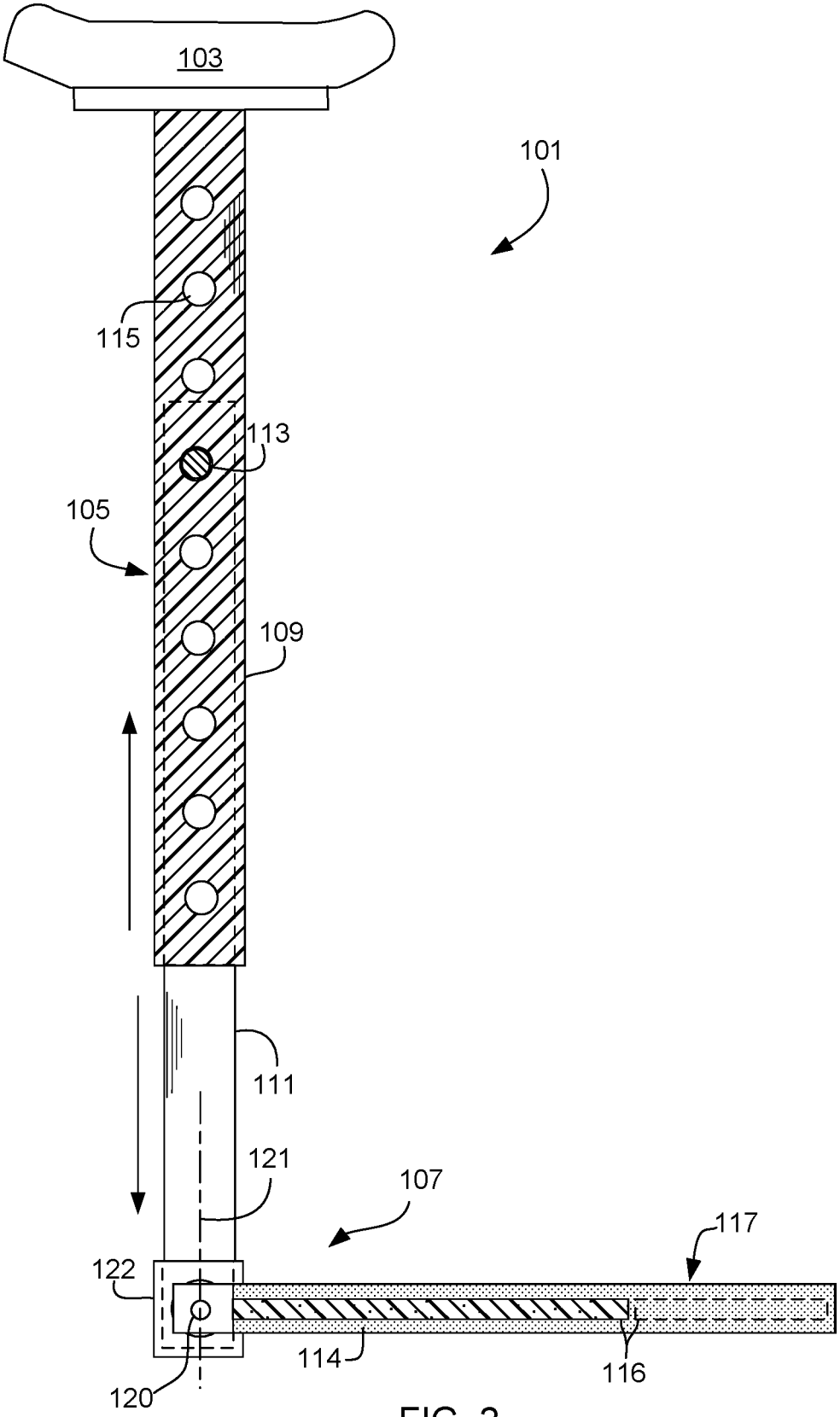
FIG. 2 is a partial section side view of the golf swing training device of FIG. 1.
Figure 3:
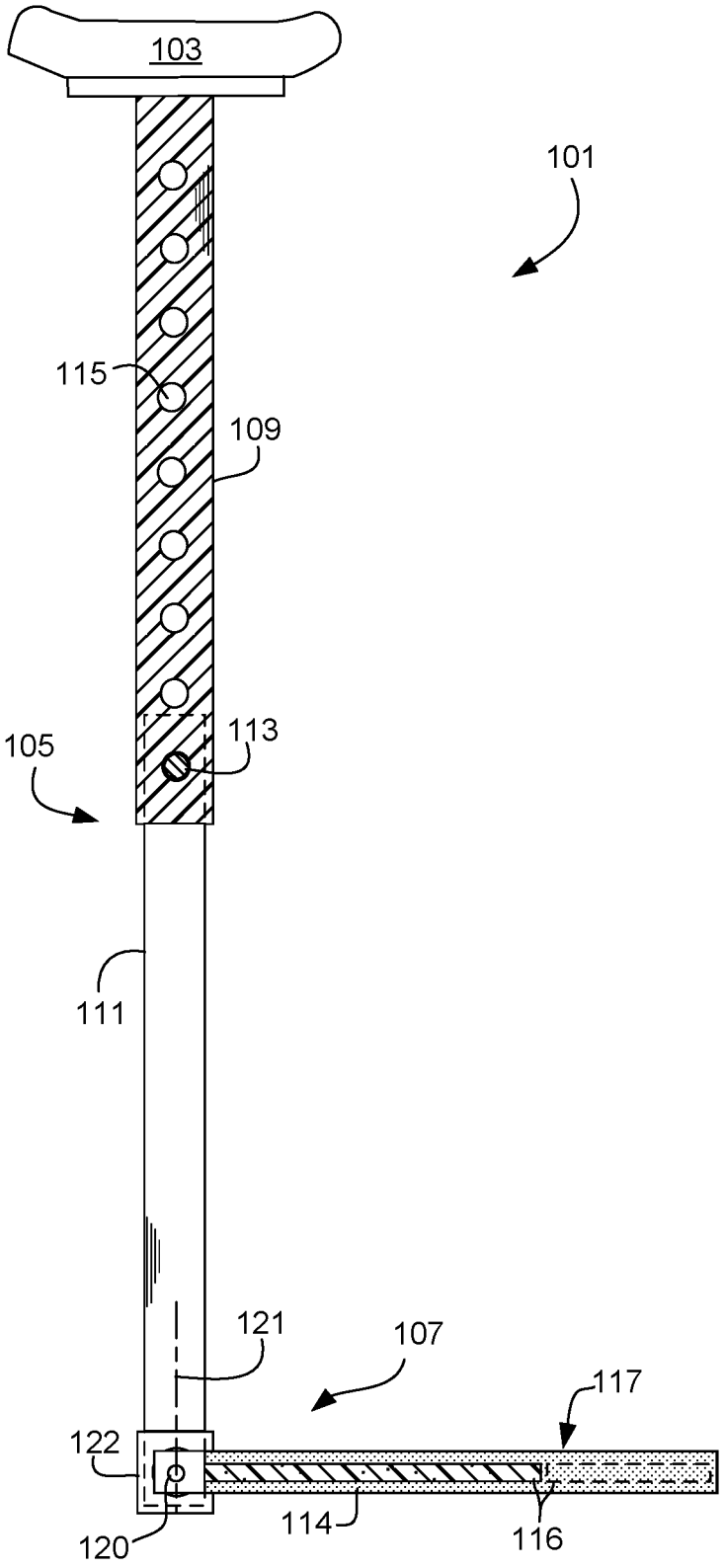
FIG. 3 is a side view of the golf swing training device of FIG. 2 with an extended shaft.

Referring now also to FIGS. 2 and 3 in the drawings, side views of device 101 are illustrated. FIGS. 2 and 3 are useful to show the extendability of the central shaft. Device 101 includes a shoulder pad 103, a shaft 105, and a wrist attachment member 107. Device 101 is configured to be easily transported by golfer 99, such that device 101 may be carried in the golf bag. Additionally, device 101 is very compact and discrete.

Pad 103 is configured to rest within the armpit of shoulder 98. At this location, pad 103 acts as a pivot point for movement of the torso of golfer 99. Pad 103 is padded to as to increase comfort of the golfer. The precise shape and contour of pad 103 is not limited to the configuration herein. In some embodiments, the size of pad 103 may be adjustable wherein the ends may collapse inward. Additionally, pad 103 may be removable to permit interchanging of pad 103 with the other components in device 101.

Shaft 105 extends between pad 103 and wrist attachment member 107. Wrist attachment member 107 is configured to releasably couple to wrist 95 which is on leading arm 97. Device 101 continuously engages both wrist 95 and the shoulder of arm 98 during a swing movement. Shaft 105 is configured to be adjustable in that the length of shaft 105 can vary. The adjustability of shaft 105 may be done in different ways. For example, as seen in FIGS. 2 and 3, shaft 105 includes an upper portion 109 and a lower portion 111. Lower portion 111 translates within portion 109. A depressable pin 113 is located in portion 111 and automatically passes into one of a number of available apertures 115 in upper portion 109. To adjust the length of shaft 105, the golfer merely depresses pin 113 beneath aperture 115 and translates portion 111 to a second aperture. As seen in the Figures, multiple apertures 115 may be provided. In FIG. 3, shaft 105 is extended. In FIG. 2, shaft 105 is partially retracted.

The ability to lengthen or shorten shaft 105 allows device 101 to be used by different golfers, or as a golfer matures and ages. A secondary example of a manner in which shaft 105 permits adjustability in length is by permitting lower portion 111 to be removed from upper portion 109. A golfer can interchange different length of lower portions to accommodate a desired length. Along this same line of thought is the detachability of upper portion 109 from the base of pad 103. The natural progression of device 101 would facilitate a shaft 105 wherein the shaft is of a rigid length but wherein attachment member 107 and pad 103 are detachable therein. In any of the manners described above, the overall length of shaft 105 is adjustable or selectable by a golfer to suit their personal needs.

Figure 4:
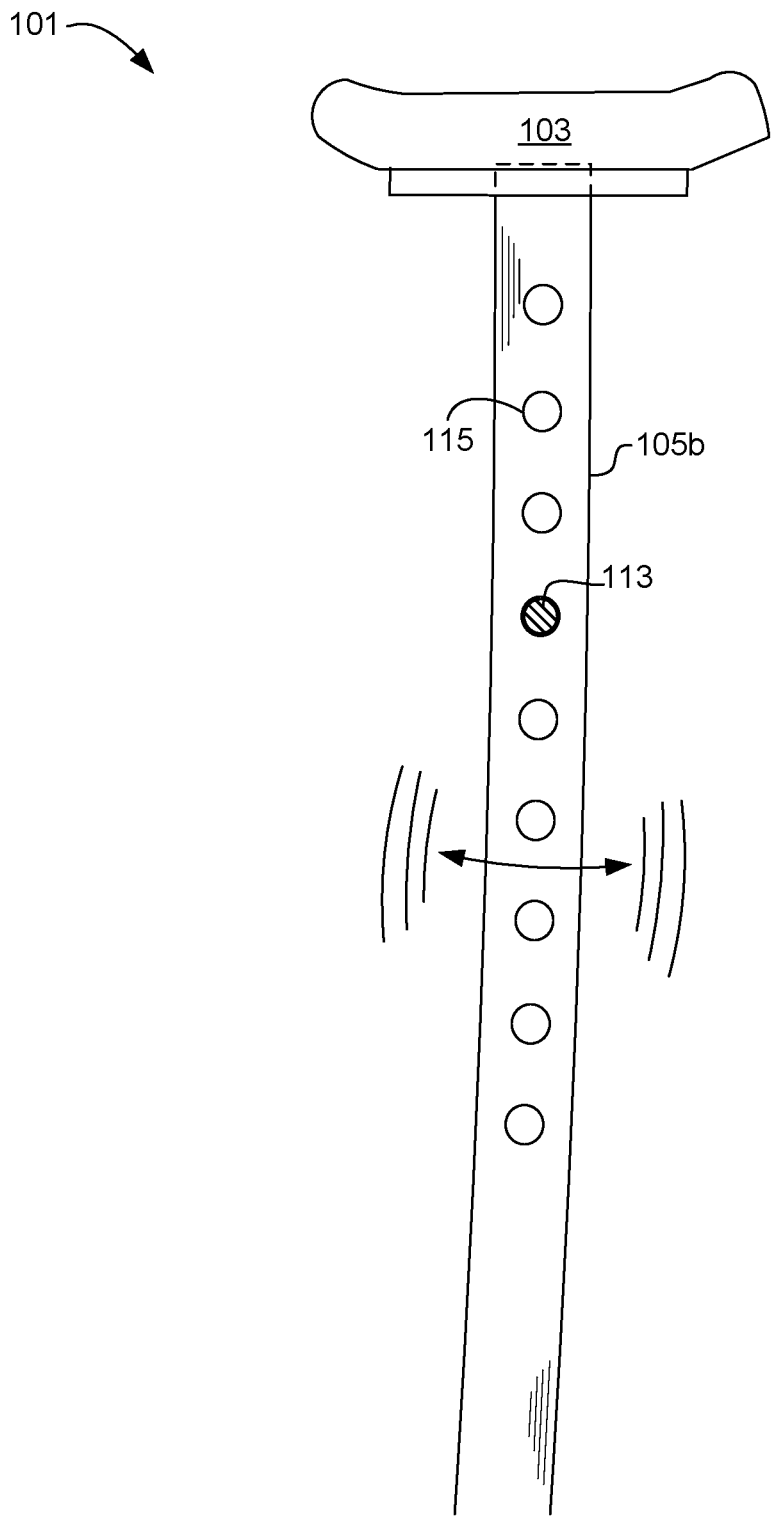
FIG. 4 is a side view of the golf swing training device of FIG. 1 with the shaft flexing.

Referring now to FIG. 4 in the drawings, a side view of shaft **105*b* is illustrated. Shaft 105*b* is similar in form and function to shaft 105 except that shaft 105*b* is a singular shaft without the ability to extend or shorten as seen with shaft 105. Shaft 105 and 105*b* are fairly rigid in its strength but is configured to provide some flexure during movement of a golf swing. This aids in some comfort to the golfer among other things. It is understood that the various different manners and methods of adjusting the length of shaft 105 and 105*b* mentioned above also applies to the ability to adjust the flexure or rigidity of shaft 105 and 105*b*. Shaft 105 may be modified in length as well as rigidity by either making a modification to the length (more rigidity from the greater length of insertion of lower portion 111 into upper portion 109) of one or more portions, or by simply swapping out the entire shaft. Shaft 105*b*** is interchangeable to permit adjustment in length.

Figure 5:
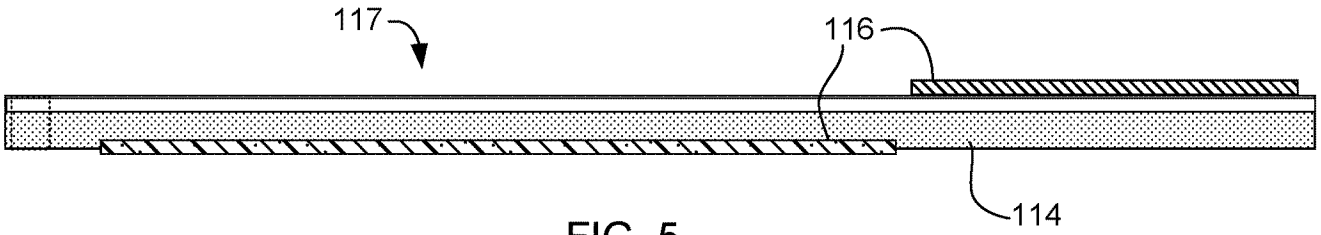
FIG. 5 is a top view of a strap in an attachment member of the golf swing training device of FIG. 1.
Figure 6:
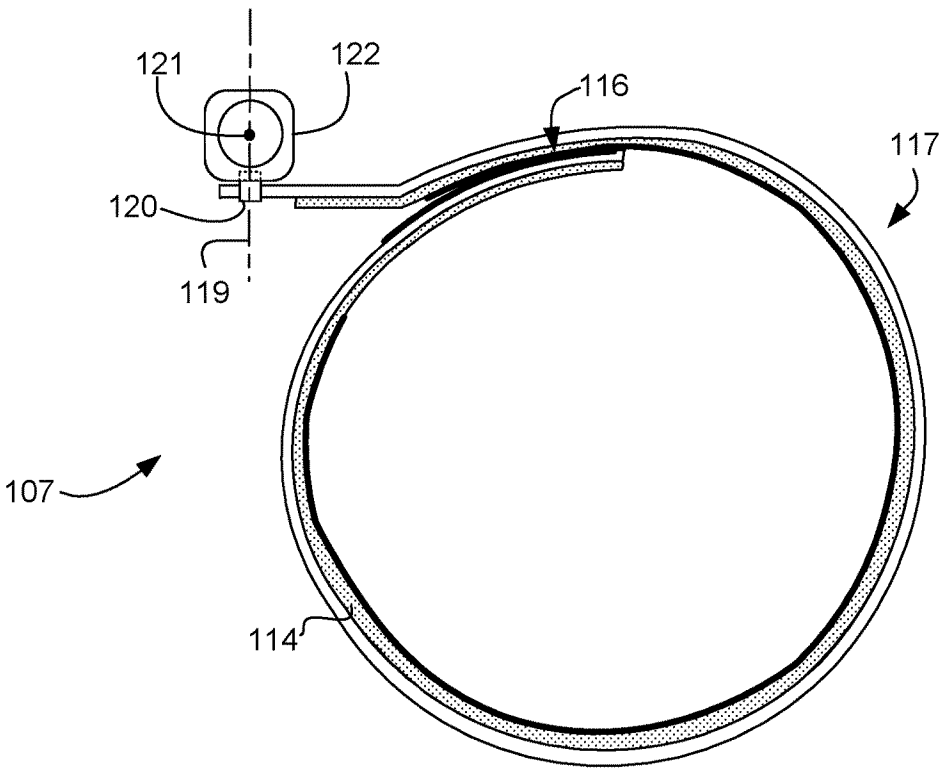
FIG. 6 is a secondary top view of the strap of FIG. 5.

Referring now also to FIGS. 5 and 6 in the drawings, top views of a strap 117 used with wrist attachment member 107 is illustrated. Wrist attachment member 107 includes a cap 122 and a strap 117. Strap 117 is flexible and dual sided. Strap 117 includes a pad 114 and an attachment device 116. Device 116 is a hook and loop fastener system wherein the loop side is shown on the same side as pad 114. The hook side is opposite that of pad 114 such that in use, the user wraps the padded side of strap 117 about the wrist so that the hook portion of device 116 contacts the loop side (see FIG. 6). Pin 120 is used to secure strap 117 to cap 122.

Wrist attachment member 107 is configured to permit the free rotation and movement of wrist 95 about the base of shaft 105 during a swing. Rotation may be provided through the introduction of one or more pivot axes, pivot axis 119 and pivot axis 121 for example. Pin 120 permits strap 117 to rotate about axis 119 and cap 122 permits rotation about axis 121. Cap 122 is configured to couple to shaft 105 and swivel or rotate about the shaft. One or more bearings, shafts, or pins may be used to allow singular rotation about a singular axis. In another embodiment, member 107 may includes a bearing located on a second end of (lower end) of shaft 105 which permits strap 117 to rotate about multiple axes simultaneously. Because strap 117 is flexible, it naturally provides some movement and flexure of rotation during a swing. Therefore, the includes of cap 122 being rotatable about axis 119 is optional. Furthermore, although pin 120 and rotatable axis 119 have been disclosed, it is understood that each are optional, such that strap 117 is configured to flex and permit flexure and rotation about shaft 105.

The current application has many advantages over the prior art. The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A golf swing training device used to maintain a proper form in an upper body of a player, comprising:

an elongated shoulder pad having a length;

a rigid shaft having a first end and a second end, the first end in communication with the shoulder pad, such that the shoulder pad covers the first end of the rigid shaft, the rigid shaft being centered in the shoulder pad, the rigid shaft having a lower portion adjacent the second end and an upper portion adjacent the first end, the lower portion being detachable from the upper portion, the lower portion translating within the upper portion and is adjustable in length by selectively engaging at least one aperture of a plurality of apertures in the upper portion; and a wrist attachment member coupled to the second end of the shaft and includes a strap configured to selectively open and close about the wrist of the player, the strap permitted to pivot within the wrist attachment member so as to permit the free rotation of the strap about the second end of the shaft;

wherein the length of the shaft is selectively adjustable to set a fixed length;

wherein the length of the shoulder pad is perpendicular to a length of the shaft, the shoulder pad being aligned with the length of the shaft so as to cover over the first end.

2. The device of claim 1, wherein the shoulder pad is curved so as to be conforming to the shape of a golfer.

3. The device of claim 1, wherein the shaft is detachable from the shoulder pad.

4. The device of claim 1, wherein the wrist attachment member is configured to pivot about a plurality of axes.

5. The device of claim 1, wherein the strap is configured to pivot about a singular axis.

6. The device of claim 1, wherein the strap includes an attachment device configured to secure the strap to itself.

7. The device of claim 6, wherein the attachment device is a hook and loop fastener.

8. The device of claim 1, wherein the wrist attachment member includes a pad.

* * * * *